United States Patent [19]

Holtzman et al.

[11] Patent Number: 4,773,530

[45] Date of Patent: Sep. 27, 1988

[54] PACKAGE CONTAINING A BOOKLET OR FOLDER INSERT

[75] Inventors: Seymour Holtzman, Kingston, Pa.; Earl Zimbler, Wilmette, Ill.

[73] Assignee: Jewelcor, Inc., Wilkes-Barre, Pa.

[21] Appl. No.: 136,473

[22] Filed: Dec. 23, 1987

Related U.S. Application Data

[63] Continuation of Ser. No. 848,997, Apr. 7, 1986, abandoned.

[51] Int. Cl.[4] ..... B65D 75/54

[52] U.S. Cl. ..... 206/232; 206/566; 217/58; 217/60 R

[58] Field of Search ..... 206/232, 566, 1.8; 217/58, 60 R

[56] References Cited

U.S. PATENT DOCUMENTS

| | | | |
|---|---|---|---|
| 1,017,006 | 2/1912 | Lee | 206/232 |
| 1,941,922 | 1/1934 | Worth | 206/0.8 X |
| 2,580,141 | 12/1951 | Vidal | 206/232 |
| 2,716,484 | 8/1955 | Weppler | 206/232 |
| 2,926,866 | 3/1960 | Morin | 206/232 X |
| 3,243,037 | 3/1966 | Luertzing | 206/232 |
| 3,385,423 | 5/1968 | Hayes | 217/60 R |
| 3,416,655 | 12/1968 | Shiffman | 206/566 |
| 3,679,047 | 7/1972 | Papirnyik | 206/232 X |
| 3,809,216 | 5/1974 | Ferguson | 217/58 X |
| 4,365,708 | 12/1982 | Tyus | 206/232 X |
| 4,452,373 | 6/1984 | Pearce et al. | 206/566 |
| 4,470,488 | 9/1984 | Broussard | 206/1.8 |

FOREIGN PATENT DOCUMENTS

| | | | |
|---|---|---|---|
| 3013878 | 10/1981 | Fed. Rep. of Germany | 206/232 |
| 480608 | 10/1975 | U.S.S.R. | 206/566 |

*Primary Examiner*—William Price

*Attorney, Agent, or Firm*—Kuhn and Muller

[57] ABSTRACT

A container, typically for a watch, has a chamber defined by its bottom and a parallel member extending between the side walls adjacent the bottom and one of the side walls provides access to the chamber, which is intended to receive a booklet or folder having indicia and/or graphics pertinent to the contents of the container. The parallel member is provided with an opening permitting contact with the booklet or folder by thumb or finger.

4 Claims, 2 Drawing Sheets

PACKAGE CONTAINING A BOOKLET OR FOLDER INSERT

This application is a continuation, of application Ser. No. 848,997, filed Apr. 7, 1986 and now abandoned.

This invention relates to a container, storage box or package, and is more particularly concerned with a container or storage box adapted to hold a watch or other item or items and provided with a chamber for holding a readily-accessible booklet or folder containing indicia and/or graphics relating to the contents of the container or box.

BACKGROUND OF THE INVENTION

Various items such as watches are conventionally transported, sold and stored in containers and are accompanied by booklets or folders containing indicia and/or graphics in the form of instructions, warranties and the like. These booklets or folders are ordinarily loosely positioned inside the box along with the watch or other item or are loose and separately accompany the box. In either case, the booklets or folders are easily lost and this can cause much distress to the owners.

Containers or packages for various items have been disclosed which provide means for holding booklets or other units with related graphics and/or indicia. Typical of such containers are Beadle, U.S. Pat. No. 2,644,259, Luertzing, U.S. Pat. No. 3,243,037 and Papirnyik U.S. Pat. No. 3,679,047. Thus, Beadle U.S. Pat. No. 2,644,259 shows a box for pills or other pharmaceutical preparations which has a body to hold the pills and a cooperating hinged top which is formed with "nubs" for removably retaining a transparent plastic retainer plate behind which are inserted labels or the like which provide the appropriate prescription data for the contained pills, as well as information regarding the pharmacy supplying the pharmaceutical preparations. Two labels are contemplated, one being visible through the transparent retainer plate, and the other, facing in the opposite direction, being visible through the transparent top. Luertzing, U.S. Pat. No. 3,243,037 discloses a package for glassware, particularly chemical glassware, and has a top and bottom shaped with interior recesses or seats to hold flasks, condensers, funnels, and the like. In addition, a pocket 45 is formed in the top "to receive therein brochures and the like." Papirnyik, U.S. Pat. No. 3,679,047 describes a box for storing attachments and an instruction booklet for a sewing machine or similar household appliance. The box has a body for the storage of the attachments and a transparent plastic top cover for storing the instruction booklet. Interiorly of the cover of the box, narrow shelves loosely support the booklet, which is bowed or flexed to fit the shelves and is visible through the transparent cover to identify the model number and to provide other indicia and/or graphics. While the disclosed containers are provided with arrangements for storing the booklets, folders or other indicia-bearing units in the container, the storage is not secure and it is possible, especially in the case of booklets, for the indicia-bearing units to become displaced and separated from the containers accidentally when the contained item is being introduced or removed or when the container is tilted, and any booklet or other indicia-bearing unit may be thereby lost. These disclosed containers are an improvement over previously-known containers in which a booklet or folder or other indicia-bearing unit is just loosely placed in the box along with the item or items for which the box is used but there still remains room for improvement, particularly from the standpoint of positively and firmly but removably retaining a booklet or folder with graphics or indicia which relate to the contained item.

OBJECTS AND BRIEF DESCRIPTION OF THE INVENTION

It is accordingly an object of the present invention to provide a box or container for the handling, sale and storage of a watch or the like, which is provided with means for securely holding and retaining a booket or the like with graphics and/or indicia pertaining to the watch or other item contained in the box, yet which is readily accessible when desired.

It is a further object of the invention to provide a container of the character indicated from which the stored booklet or indicia-bearing unit cannot be accidentally displaced.

It is still another object to provide a package comprising a packaging unit and a packaged item containing graphics and/or indicia.

Other objects and features of the invention will be readily apparent from the following description of the invention and from the accompanying drawings of an illustrative embodiment thereof.

In accordance with the invention, a container, having a body and a cover, preferably hinged to the body, is provided in its body with a slot of limited height which is adapted to hold a booklet or folder tightly against slippage yet is provided with means permitting engagement of the booklet or folder with the thumb or finger to remove the indicia-bearing unit when desired.

The invention also contemplates a package which has side walls and a bottom and a means which define a chamber with the side walls and bottom, and a folder or booklet with graphics or indicia contained in secure but removable position in the chamber.

BRIEF DESCRIPTION OF DRAWINGS

In the drawings, to which further detailed reference will be made.

DESCRIPTION OF PREFERRED EMBODIMENT

Figure 1:
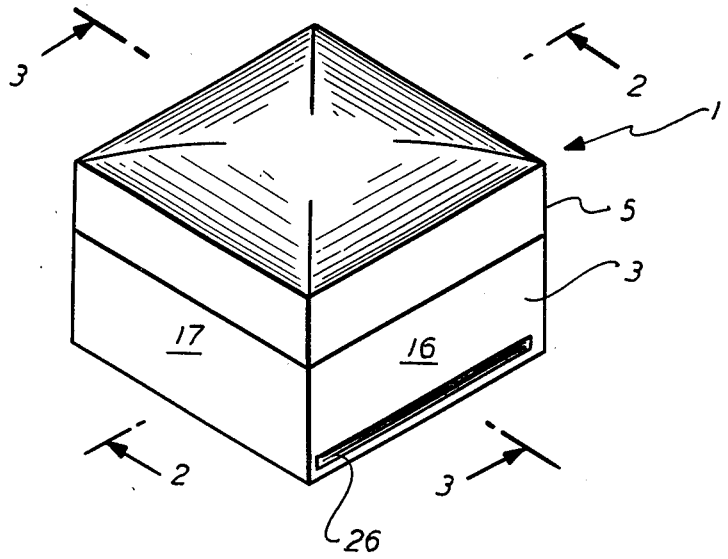
FIG. 1 is a perspective view showing the top, rear and side of a watch container which embodies features of the present invention.
Figure 2:
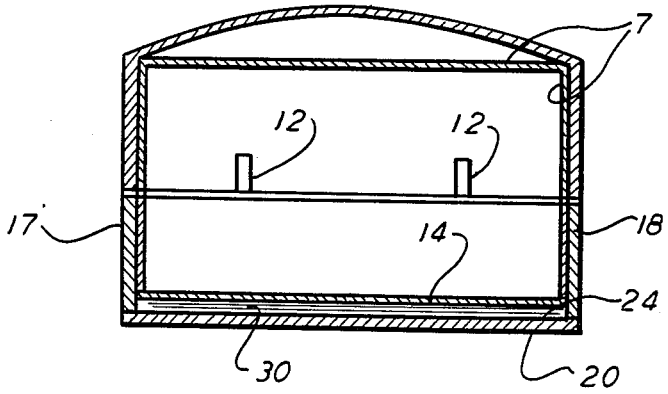
FIG. 2 is a sectional view taken approximately along the line 2—2 of FIG. 1.
Figure 3:
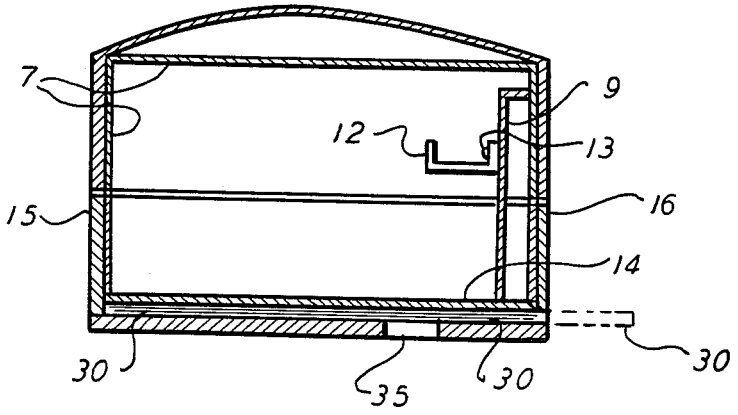
FIG. 3 is a sectional view taken approximately along the line 3—3 of FIG. 1.

Referring to the drawings, and particularly to FIG. 1, the reference numeral 1 designates generally a container for a wrist watch having a body 3 provided with a mating cover 5, conveniently hinged to body 3 by any effective hinge means (not shown). The body 3 and cover 5 are suitably formed from a rigid plastic material, e.g. a phenol-formaldehyde resin, or the like, which may be colored in any desired hue, and readily formed by molding. Container 1 may be opaque or transparent, but is preferably the former. As shown in FIG. 2 and FIG. 3, the body 3 and the cover 5 are lined interiorly with a lining 7 which is secured, as by gluing, to the interior surface of body 3 and the interior surface of cover 5 and has a stiff central portion 9 which limits the movement of cover 5 relatively to body 3. A watch-supporting bracket of conventional form is shown at 12, secured, as by a rivet 13, to the rigid liner 9. In accordance with the invention, the body 3 is formed with a bottom 14, front and rear walls 15 and 16, and side walls 17 and 18, and has a secondary bottom 20 which is parallel to but spaced from the exterior or bottom surface of bottom 14 i.e. in the direction of the open end of walls 15, 16, 17 and 18, to define a chamber 24 in the body 3. The rear wall 16 is cut away between its lines of contact with bottom 14 and secondary bottom 20 to form a slot 26 which allows access to chamber 24. While rear wall 16 is shown as cut away in the embodiment illustrated, it will be apparent that the cut away could be made in any one of the other three walls, since similar access to chamber 24 would thereby be achieved. Similarly, the container could have more than four walls, if desired. What are termed "front" and "rear" walls may also be considered "side" walls.

When the container is formed by molding a plastic substance, as mentioned above, the four side walls, the secondary bottom 20, a recess for the chamber 24, and the cut-away in one of the walls can be molded as one piece, and the bottom 14 can be separately formed and attached, as by gluing, to the molded unit parallel to the bottom 14. The recess is thereby closed, except for the slot 26 shown in FIG. 1 and the chamber 24 is formed. Other ways of making the body and providing chamber 24 can, of course, be employed.

Referring to FIGS. 1, 2 and 3, a booklet 30 with graphics or indicia is shown by broken lines as seated in chamber 24. The booklet 30 can readily be inserted in chamber 24 by introducing it through slot 26. It is a feature of the invention that the folder will be held securely in chamber 24 at all times regardless of the spatial orientation of the container. For this purpose, the bottom surface of bottom 14 or the upper surface of secondary bottom 20, or both, may be roughened or otherwise provided with a friction-increasing characteristic, as by overlaying them with felt or plush or rubber 21, or the like. Effective increase in friction can, however, be achieved by making the slot 26 and the height of chamber 24, i.e. the distance between the opposing surfaces of bottoms 14 and 20, of a small dimension compared to the thickness of the booklet 30 to be stored in chamber 24 so that it will be necessary for the booklet to be compressed, or squeezed together, as it is inserted in the chamber, and thus it will be frictionally engaged with the top and bottom of chamber 24. The booklet is dimensioned to fit entirely within chamber 24.

The user will, however, want at some time to remove the booklet 30 from its storage position, securely concealed in body 3. For this purpose, and in accordance with the invention, the secondary bottom 20 is provided with an aperture 35 which is preferably centrally located between walls 17 and 18 near slot 26. The aperture may be circular, elongated or of any desired form to permit the user's thumb or finger to contact the booklet in chamber 24 and move it toward slot 26. Simple movement of the thumb or finger toward slot 26 will serve to expel the booklet 30 from chamber 24, as shown in phantom lines in FIG. 3.

It will be apparent, therefore, that the container can be repeatedly opened and closed without exposing the booklet 30 to loss and the booklet will be effectively stored until needed by the user. In effect, therefore, there is provided a package composed of a containing unit and a contained booklet or folder or other indicia-bearing unit.

Figure 4:
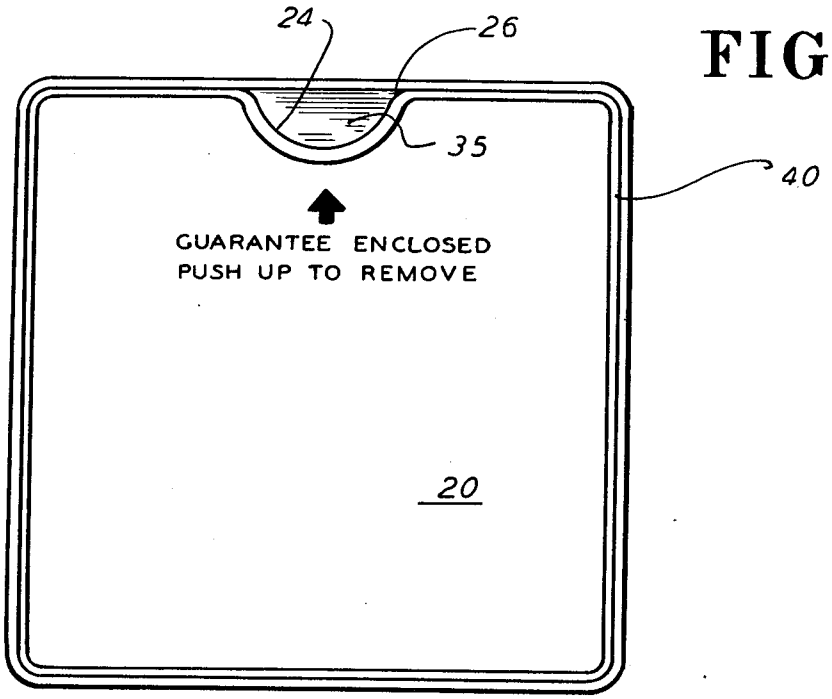
FIG. 4 is a bottom view of another embodiment of a container in accordance with the invention.
Figure 5:
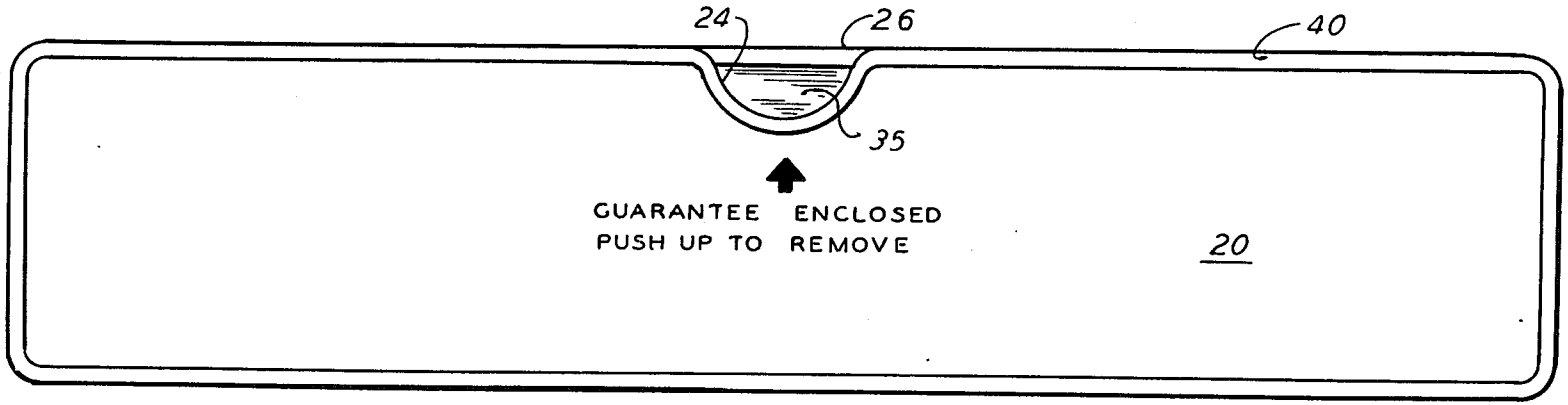
FIG. 5 is a bottom view of still another embodiment.

While in the embodiment shown in FIGS. 1–3, the aperture 35 is shown as a hole spaced from all four edges of secondary bottom 20. The aperture can merge with one of the edges preferably the one coinciding with the slot 26, as shown in FIG. 4, wherein like parts are given like reference numerals. In FIG. 4 the aperture 35 merges with the rear edge of secondary bottom 20, adjacent slot 26, and thus the aperture 35 has a semicircular shape. It could also have a different shape. Furthermore, while the embodiments of FIGS. 1–3 and 4 have a cross-section which is approximately square, it will be apparent that the features of the invention can be embodied in boxes or containers of other geometrical cross-section, as has been alluded to before. For example they may have a cross-section, and therefore a secondary bottom which is generally hexagonal, octagonal or rectangular of non-square shape, e.g. long in one dimension and short in the other. The secondary bottom 20 of such a container is shown in FIG. 5, wherein like parts of FIGS. 1–4 are given like reference numerals. In FIG. 5, the secondary bottom 20 has long front and rear edges and short side edges, and, like the embodiment of FIG. 4, the aperture 35 merges with the rear edge of secondary bottom 20 and thus with slot 26 and has a semicircular shape, but, as shown in FIGS. 1–3, the aperture 35 could be spaced from all four edges. It could also have another shape.

In the embodiments of FIGS. 4 and 5, the edges of secondary bottom 20 and aperture 35 are lined by a ridge or embossment upon which the container is adapted to rest. The remainder of the embodiments of FIGS. 4 and 5 have the same structure described above for the embodiment of FIGS. 1–3, e.g. side walls, top or cover chamber 24, bottom, etc. although the interior may differ, e.g. the lining, any article-supporting bracket, and the like, depending upon the article or articles for which the container is intended.

It will be apparent that various other changes and modifications of the embodiments illustrated may be made without departing from the invention as defined in the appended claims. For example, the secondary bottom 20 may be spaced from bottom 14 throughout its extent or it may be only partially spaced inwardly from slot 26 or side walls 17 and 18 to define a chamber of limited inward depth from slot 26 or limited width between opposing side walls. Similarly, while the embodiments illustrated are constructed to contain wrist watches, they may be constructed to contain any other item or items. It is intended, therefore, that all matter contained in the description and in the drawings shall be interpreted as illustrative only and not as limitative of the invention.

What is claimed is:

1. A container for transporting and displaying personal accessories of dress, said container comprising:

a body and a cover pivotally connected to said body;

lower and upper compartments formed respectively within said body and said cover, each of said compartments having a plurality of interior sidewall surfaces;

means interconnecting said lower and upper compartments for limiting the movement of said cover relative to said body between a closed position and an open position;

means connected to said movement limiting means for dividing said lower compartment into first and second chambers, said first chamber overlying said second chamber when said cover is in either of said closed and open positions, said first and second chambers being defined at least in part by corresponding upper and lower portions of the interior sidewall surfaces of said lower compartment; and at least two apertures formed in said body and opening only into said second chamber in substantially orthogonal directions, one of said apertures being adapted to permit the passage into said second chamber of printed matter.

2. The container of claim 1 in which said first and second chambers are coextensive in length and width.

3. The container of claim 1 comprising a support connected to said movement limiting means within one of said upper and lower compartments and adapted to retain the accessory when said cover is in either of said closed and open positions.

4. The container of claim 1 in which said one of said apertures extends through one of said interior sidewall surfaces.

* * * * *